United States Patent [19]

Hartline

[11] 4,146,168

[45] Mar. 27, 1979

[54] ONE-PIECE BOTTLE CARRIER

[76] Inventor: Herbert A. Hartline, 11151 W. 32nd Ave., Wheatridge, Colo. 80033

[21] Appl. No.: 852,858

[22] Filed: Nov. 18, 1977

[51] Int. Cl.[2] ..... B65D 75/00

[52] U.S. Cl. ..... 229/28 BC

[58] Field of Search ..... 229/28 BC

[56] References Cited

U.S. PATENT DOCUMENTS

| | | | |
|---|---|---|---|
| 2,281,592 | 5/1942 | O'Brien | 229/28 BC X |
| 2,373,851 | 4/1945 | Potter | 229/28 BC X |
| 2,375,631 | 5/1945 | DeVillard | 229/28 BC X |
| 2,393,114 | 1/1946 | Lyons, Jr. | 229/28 BC X |
| 2,397,549 | 4/1946 | Koolnis | 229/28 BC X |
| 2,417,421 | 3/1947 | Koolnis | 229/28 BC X |
| 2,421,850 | 6/1947 | Ringler | 229/28 BC X |
| 3,780,906 | 12/1973 | Katzenmeyer | 229/28 BC X |

*Primary Examiner*—Davis T. Moorhead

*Attorney, Agent, or Firm*—Kyle W. Rost

[57] ABSTRACT

A one-piece bottle carrier is formed from a single rectangular piece of sheet material having a length equal to the longitudinal length of the carrier, the material being scored and folded to form a bottom, two sides, a top, and an upwardly extending handle that can be lifted above the height of the bottle tops, but that can be depressed to a height equal to the bottle tops. The carrier is characterized by the lack of a central wall connecting the top to the bottom between the rows of bottles. Apertures in the top wall engage the sides of the bottles and hold the bottles at a predetermined distance.

3 Claims, 6 Drawing Figures

ONE-PIECE BOTTLE CARRIER

BACKGROUND OF THE INVENTION

1. Field of the Invention

The invention relates to paper receptacles. More specifically, the invention relates to bottle carriers of the kind traditionally formed from cardboard and used to store, ship, and hand-carry bottles containing beverages.

2. Description of the Prior Art

Bottle carriers commonly known as six-packs are used to carry a variety of beverages including soft drinks and beer. Most of these carriers are complex in structure, including a bottom wall under each of the carried bottles and four side walls forming a compartment with an enclosed perimeter that surrounds each bottle. In the typical six-pack carton, there will be six compartments arranged in two longitudinal rows of three compartments each. A central handle may be associated with the compartment walls forming the common side between the two rows. The primary disadvantages of this type of carton are that it requires complicated folding to construct the carton and a great deal of cardboard is wasted in cutting the blank that is formed into the final product.

One of the limiting features for carton construction is defined by Rule 41 promulgated by the Uniform Freight Classification Committee, which is comprised of the railroad industry. The rule requires that there be no bottle to bottle contact, the grade of board used for a carrier be a minimum of 0.024 inches in calipher and test at 92 pounds per thousand square feet. When the requirements of the rule are met, the railroad will be responsible for damage in transit. While every shipper desires to accommodate the rule, it is important to ship a load compactly and with a minimum of weight and bulk. Therefore, it is important that the required interbottle cushioning be achieved while keeping the carton size to a minimum.

SUMMARY OF THE INVENTION

A one-piece bottle carrier for containing a plurality of at least four bottles arranged in two longitudinal rows is formed from a single rectangular piece of paperboard having a length equal to the length of the formed carrier. The rectangle is folded into a parallelogram with a bottom wall underlying the carried bottles, a pair of side walls parallel to the longitudinal axis of the carton and covering the outer edge of the two longitudinal rows of bottles, and a top wall connected between the side walls and having apertures therein that allow the necks and tops of the bottles to protrude upwardly. A folded portion of the rectangle extends upwardly from the bottom wall between the rows of bottles; a portion of the rectangle depends from the top wall between the rows of bottles; and a folded portion extends vertically upwardly from the top wall to form a handle between the rows of bottles. The apertures in the top wall snugly engage the shoulders of the bottles when the handle is pressed vertically downwardly, as by another carton of bottles resting on the carrier. The bottles are held at a predetermined interbottle distance by the spacing of the apertures when the handle is so depressed.

An object of the invention is to create a simple carrier that is suitable for maintaining a predetermined spacing between bottles in a carrier. The present invention is a bottle carton that is formed from a rectangle only as wide as the finished carton. The rectangle is folded along lines parallel to the longitudinal axis of the carton to form a four sided carrier with spacing materials between the longitudinal rows of bottles. The predetermined spacing between adjacent bottles of each row is achieved by properly spaced apertures in the top wall of the carton plus the proper dimension of the handle so that the handle presses the top wall downwardly against the bottles when a load is applied against the top of the handle.

Another object is to create a wrap-around bottle carrier having two open ends, but that retains the bottles within the carrier when lifted. Although the present carrier is constructed from a rectangle no wider than the finished carrier, the bottles are retained within the open ends by a pinching action as the carton is lifted by its handle. There is no longitudinal center wall connecting the top side to the bottom side of the carrier. Therefore, when the handle is used to lift the carrier, the top wall is deflected upwardly while the bottom wall retains its original configuration. The side walls are pulled toward the handle at their upper ends, pinching the bottles between the side walls and retaining the bottles in the carrier.

DESCRIPTION OF THE PREFERRED EMBODIMENT

Figure 1:
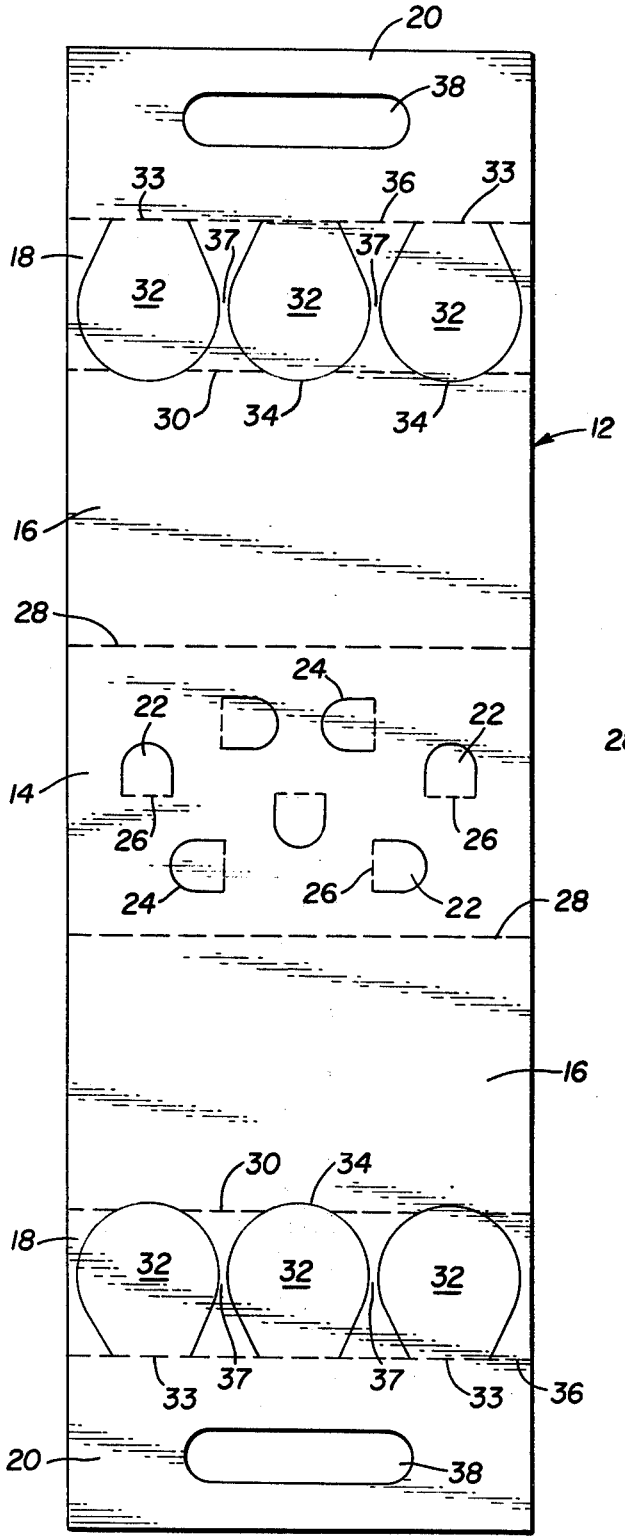
FIG. 1 is a plan view of the blank to be formed into the carrier.
Figure 2:
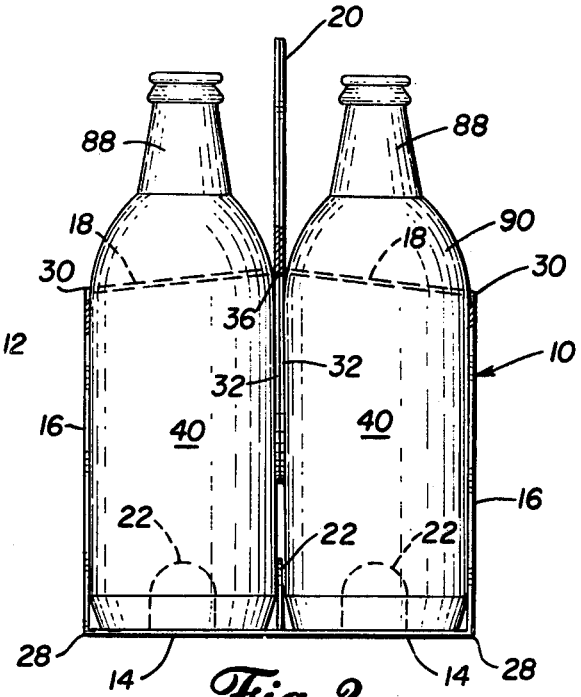
FIG. 2 is an end elevational view of the carrier with bottles inserted and the handle in raised position.
Figure 3:
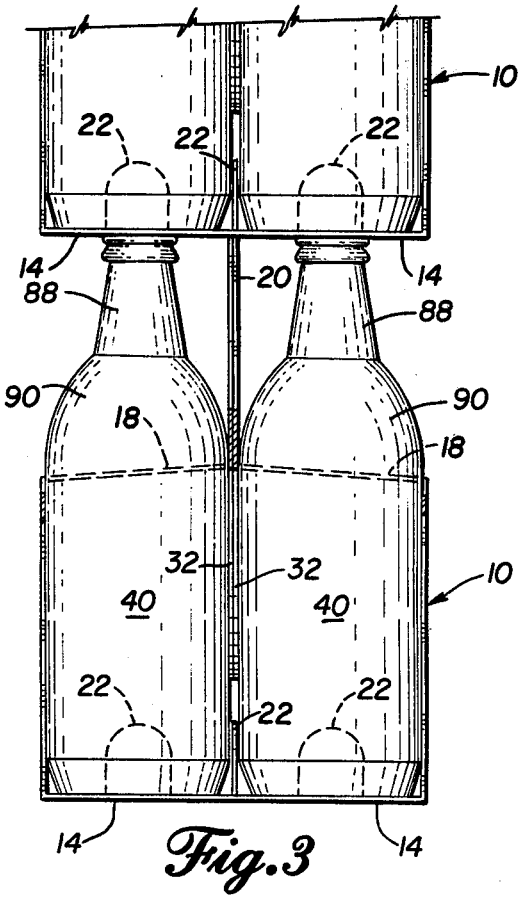
FIG. 3 is an end elevational view of the carrier in stacked arrangement with the handle depressed.

According to the embodiment of the carrier 10 shown in FIGS. 1–3, a blank 12 in the shape of a single rectangle, as shown in FIG. 1, is appropriately cut and scored to be formed into the carrier. The smaller dimension of the rectangle shall be referred to as the length, while the greater dimension is the width. Near the center of the width of the blank is the area 14 to become the bottom wall, and adjacent to area 14 on either side are areas 16 that will become the sides of the carrier. Next in successive positions moving toward the ends of the blank are areas 18, each of which will form one-half of the carrier top, and finally, the blank terminates in areas 20, which will become the handle.

Area 14 is substantially the length and width of the finished carton and has a plurality of tabs 22 cut at 24, shown in solid lines on FIG. 1, and scored at 26, shown in dashed lines, so that the tabs can be bent upwardly along the score lines to form separating means between the bottles in the finished carrier. The illustrated embodiment is intended for six bottles arranged in two longitudinal rows and three columns. Accordingly, three of the tabs 22 will become central dividing means between the two rows of bottles, while four of the tabs will separate the bottles within the rows, two in each row.

Areas 16 are distinguished from area 14 by score lines 28, which allow the sides to be bent upwardly from the bottom wall area 14. The length of sides 16 is identical to that of bottom 14, and the width, which is the height of the finished carrier sides, may be any dimension less than the total height of the bottles to be carried therein.

At the border between sides 16 and top wall portions 18 is a score line 30, allowing the two top portions to be folded toward one another. Each top is further cut and scored to create openings that will receive the bottles to be contained in the carrier, each portion 18 being cut and scored to receive one row of bottles. The desired openings are formed by cutting a flap 32 from top 18, the flap remaining attached to blank 12 along a narrow portion 33 of the edge of the resulting aperture. In order to make the carrier as compact as possible, the border of the flap may extend over score line 30 into side 16 at 34 so that the bottles received in the carrier will be flush against side 16, as shown in FIG. 2. The narrow portion 33 attaching flap 32 to the blank 12 is preferably at score line 36, forming the border between each top 18 and handle area 20. The score line 36 may run across portion 33, or portion 33 may be skipped in the scoring operation, making the blank smoothly continuous between flaps 32 and handle area 20. Intermediate areas 37 separate the flaps 32 of each top wall portion 18.

Each handle area may have a grip opening 38 formed therein, for example by a punching operation. The handle is folded upwardly along score line 36 from top wall 18, and flaps 32 are accordingly folded downwardly as the handle folds upwardly. The width of the handle area 20 plus the width of the side areas 16 is approximately equal to the height of a bottle 40 to be carried in the carrier 10.

From the description of the various cuts, scores, and folding of blank 12, the resulting form of the carrier 10 can be understood to be as shown in FIG. 2. Bottom wall 14 underlies the carried bottles; side walls 16 extend upwardly from 14 at lines 28; top wall portions 18 extend inwardly from sides 16 at lines 30 and meet at lines 36; and handle portions 20 extend upwardly from lines 36 and are joined together by any convenient joining means, for example glue or staples. Tabs 22 cushion and separate the bottles 40 near their bottom ends, and flaps 32 depend from line 36 to cushion and separate the longitudinal rows of bottles near their top ends. The bottles of each row are mutually separated by the width of intermediate area 37 at top wall 18.

As is shown by comparison of FIGS. 2 and 3, the carrier is extremely compact for shipment. When stacked, as shown in FIG. 3, the carriers 10 condense slightly as handle 20 depresses to the height even with the tops of bottles 40, but when an individual carrier 10 is lifted, as shown in FIG. 2, the handle raises above the tops of the bottles, lifting the top wall portions 18 near their meeting at line 36. In turn, the top wall portions pull side walls 16 together to pinch the bottles against depending flaps 32. This height adjustment of handle 20 is possible because the carrier does not have a center wall joining the handle to the bottom wall 14, but merely has independent separating means both extending upwardly from the bottom wall and depending from the handle.

For maximum compactness of the carrier, the flaps 32 on one top wall portion 18 may be removed entirely, leaving the flaps 32 of the other portion 18 as the only separating means at the top of the bottle rows.

The embodiment of FIGS. 1–3 has the advantage of forming a returnable carrier, and the bottles may be lifted directly out of the top of the carrier and reinserted at will. This carrier may be used for other beverage containers, such as cans. The preferred material for construction is corrugated paperboard, for example E flute corrugated paper. Where a desired thickness of cushioning material is required between bottles for compliance with shipping regulations, the thickness of the paper may be the equal to the required dimension. Proper spacing between bottles is assured by tabs 22, flaps 32, and the intermediate areas 37, all holding the bottles at a predetermined distance from each other.

Figure 4:
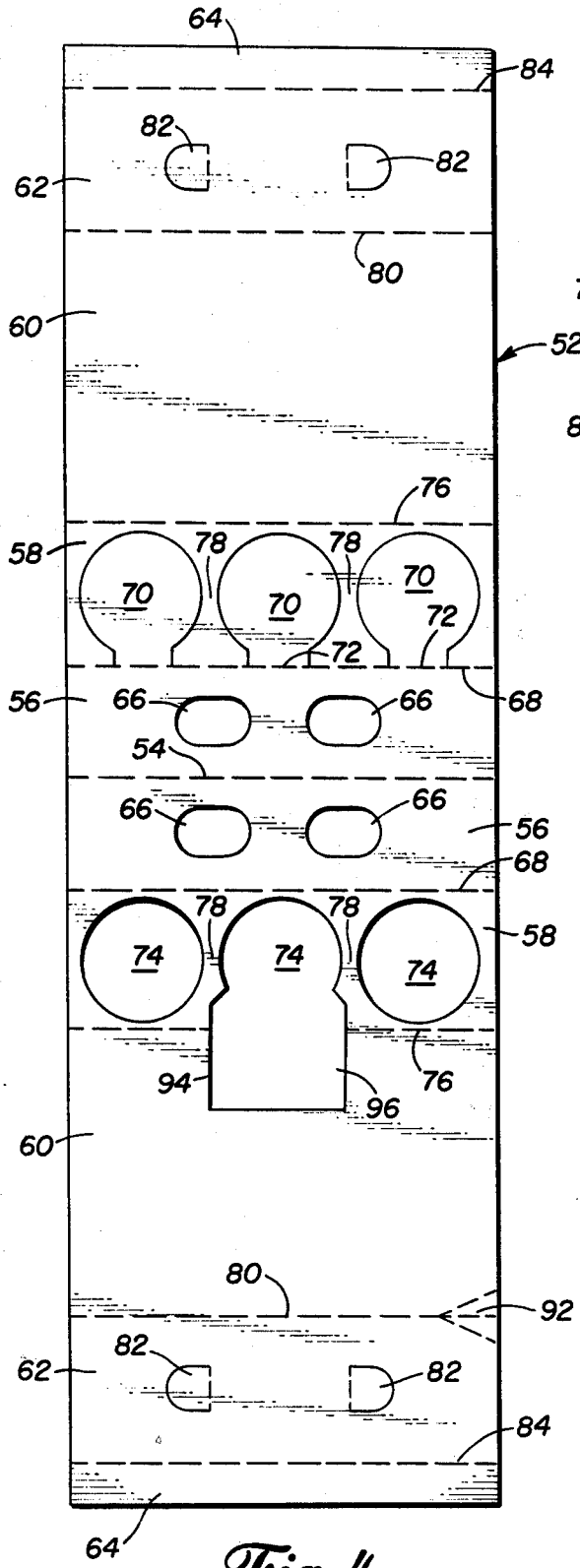
FIG. 4 is a plan view of the blank to be formed into an alternative embodiment of the carrier.
Figure 5:
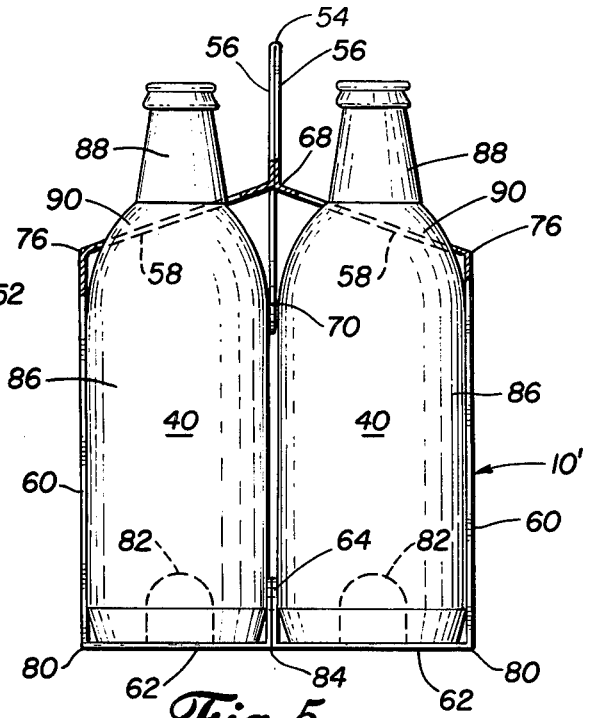
FIG. 5 is an end elevational view of the carrier formed from the blank of FIG. 4, with the handle in raised position.
Figure 6:
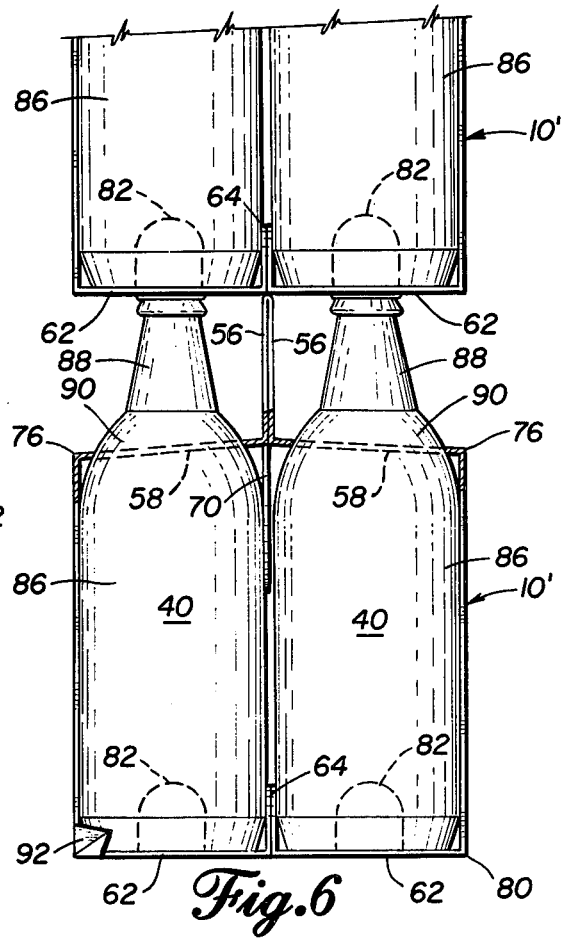
FIG. 6 is an eld elevational view of the carrier of FIG. 5 in stacked arrangement with the handle in depressed position.

FIGS. 4–6 illustrate an alternative embodiment of the carrier 10'. The rectangular blank 52 of FIG. 4 has a score line 54 near the center of the width of the blank. In consecutive order from the center line 54 to each end of the blank are handle portions 56, top wall portions 58, side walls 60, bottom wall portions 62, and longitudinal dividers 64.

The handle is formed by folding together the two portions 56 at score line 54. Matching apertures 66 in each handle portion meet to form gripping means in the handle. Score line 68 separates the handle from the adjacent top wall portions 58. Each top wall portion 58 has apertures formed therein having a shape complimentary to the cross-section of a bottle 40, for example a circle. As shown in the upper section 58 of FIG. 4, the apertures may be formed by cutting flaps 70 hingedly connected to the blank 52 by a narrow stem 72, preferably joining the blank at score line 68. The stem 72 may or may not be scored at line 68. When the carrier is folded into finished form, the flaps 70 will depend from handle portion 56 by stem 72, leaving an aperture 74 that can firmly engage the upper part of the bottle.

As shown in the lower section 58 of FIG. 4, the apertures may be formed by entirely removing circles from the blank, leaving circular openings 74 that are spaced at their circumference from score line 68 and also from score line 76 between the top wall portions and the side wall 60.

When carrier board, having a calipher of approximately 0.025 inches, is used to construct the carrier, it is preferred that the apertures in both top portions 58 be formed by cutting flaps 70 depending on stems 72, leaving a double thickness of carrier board between the shoulders of the bottles in the carrier. When E Flute corrugated paperboard is used as the carrier material, it is preferred that the apertures in one top portion be formed from hinged flaps 70, while the apertures in the other portion 58 be formed by entirely removing circles of the blank, as shown in FIG. 4. Regardless of which embodiment is used, the resulting apertures in each top portion 58 are separated by intermediate areas 78.

Side walls 60 are folded downwardly from top wall portions 58 and have score lines 80 forming the border between the side walls and the bottom wall portions 62.

Each bottom wall portion supports one row of two longitudinal rows, and tabs 82 are formed therein for separating adjacent bottles within each row.

At the ends of the blank 52 are divider portions 64, bent upwardly from bottom wall portions 62 at score line 84. Divider portions 64 may be joined together by any appropriate joining means, such as glue or staples.

In finished form, carrier 10' as shown in FIG. 5 resembles carrier 10, but a number of important differences distinguish the two embodiments. First, carrier 10' is applied over the top of the bottles and its ends 64 are joined from below, while carrier 10 is applied from under the bottles and its ends joined at the handle. Second, carrier 10' more fully encloses the bottles and is more compact than carrier 10.

As best shown in FIG. 5, each bottle 40 has a wide body 86 and a narrower neck 88 with a shoulder area 90 tapering upwardly between the body and neck. Sides 60 support top wall portions 58 at the approximate height of shoulder areas 90, and the apertures 74 are smaller in diameter than the body 86 of bottle 40. The diameter of apertures 74 is smaller than the wide body 86 so that the margins of the aperture can engage the bottle firmly at some point between body 86 and the top of the bottle, for example in shoulder areas 90.

When the carriers are stacked, as in FIG. 6, the handle portions 56 are depressed, lowering the central union of top portions 58 at score lines 68. In this position, the margins of apertures 74 hold the bottle shoulders 90 in fixed position. The spacing between bottles in adjacent rows is determined by the thickness of ends 64 and depending flaps 70, while the spacing between adjacent bottles in a single row is determined by the width of intermediate areas 78. In the preferred embodiment, the top wall portions 58 are approximately parallel to bottom wall portions 62. The width of intermediate area 78 is a function of bottle design and is equal to the difference in diameter between the widest part of body 86 and the diameter of the bottle at the point of engagement with the margins of apertures 74, plus a given spacing constant. This structure is more compact than that of FIGS. 1–3 because the intermediate area 78 may be relatively wider and correspondingly stronger than area 37 without increasing the distance between bottles in each row.

When the carrier 10' is lifted by its handle, as shown in FIG. 5, it pinches the bottles as previously explained to prevent loss of a bottle from the open ends of the carrier. Either embodiment may be modified by adding a V-shaped dart 92 to the ends of score lines 80 and indenting the lower corners of the carrier toward the bottles, to aid in retaining the bottles in the carrier. The embodiment of FIGS. 4–6 may be modified to make extraction of bottles easier by adding a removeable panel defined by line 94 adjacent to one or more of the apertures 74. When the panel is removed by a consumer, an opening 96 is created with sufficient size for easy removal of a bottle.

The concept of holding the bottles at a fixed spacing in each row may be expanded by positioning the apertures 74 to also hold the bottles of each row at a fixed distance from the other row when top portions 56 are depressed. If this is done, the aperture may hold the bottles at a spacing equal to the spacing established by depending flaps 70, or at some other spacing. The flaps 70 would retain their function of cushioning between rows of bottles when the carrier is lifted by handle portions 56.

I claim:

1. A carrier for bottles of predetermined height of the type having a wide body, a narrow neck, and a shoulder area tapering upwardly from the body to the neck, wherein the bottles are arranged in two parallel longitudinal rows, comprising:

(a) a bottom wall underlying said two rows of bottles;

(b) a pair of side walls extending upwardly from opposite edges of said bottom wall parallel to the two rows of bottles and terminating the lower edge of the shoulder area;

(c) a top wall connected to the upper ends of the side walls and having spaced apertures therein for receiving said bottles, the apertures being spaced to form two longitudinal rows corresponding to the arrangement of the bottles, the top wall having intermediate areas of predetermined length between the apertures within each row for spacing the bottles within each row at a predetermined distance;

(d) a handle with a grip opening therein connected to and extending upwardly from said top wall along the vertical plane between said two longitudinal rows of bottles;

(e) spacing means depending from said handle along the vertical plane between said two longitudinal rows of bottles and below said top wall; and (f) the top wall having no direct connection to the bottom wall along the vertical plane between the longitudinal rows of bottles for allowing the handle to raise the center of the top wall to a first position wherein said grip opening is raised above the predetermined height of the bottles and the upper portions of the side walls pinch the bottles against said spacing means, and for allowing the handle to lower the center of the top wall to a second position to release the bottles from said pinching in response to downward pressure on the handle.

2. A bottle carrier formed from a single generally rectangular sheet of material for bottles of predetermined height of the type having a wide body, a narrow neck, and a shoulder area tapering upwardly from the body to the neck, wherein the bottles are carried in two longitudinal rows, comprising:

(a) a bottom wall underlying said two rows of bottles and having the secured union between opposite ends of said rectangular sheet of material forming a part thereof;

(b) a pair of side walls extending upwardly from opposite edges of said bottom wall parallel to the two rows of bottles and terminating within the height of said shoulder area;

(c) a top wall connected to the upper ends of the side walls and having spaced apertures therein of smaller diameter than the diameter of the bottle bodies to receive and engage a portion of said shoulder area therein and maintain the bottles in spaced position in said two longitudinal rows, the top wall having intermediate areas of predetermined length between the apertures within each row for spacing the bottles within each row at a predetermined distance;

(d) a handle with a grip opening therein connected to and extending upwardly from said top wall along the vertical plane between said two longuitudinal rows;

(e) spacing means depending from said handle along the vertical plane between said two longitudinal rows of bottles and below said top wall;

(f) the top wall having no direct connection to the bottom wall along the vertical plane between the longitudinal rows of bottles for allowing the handle to raise the center of the top wall to a first position wherein the upper portions of the side walls pinch the bottles against said spacing means, and allowing the handle to lower the center of the top wall to a second position wherein the apertures firmly engage said shoulders; and (g) wherein said handle has a vertical height equal to the distance between the horizontal plane of the longitudinal center of the top wall in said second position and the plane of the tops of the bottles for automatically engaging the bottles in the apertures when a stacked load is placed on top of the carrier.

3. The carrier of claim 2, wherein the bottles in said longitudinal rows are spaced at a predetermined distance and said top wall has an intermediate area between the apertures of each row, the width of the intermediate area being the difference in the diameter of the widest part of the bottle body and the part of the bottle shoulder firmly engaged by said aperture, plus the predetermined distance.

* * * * *